US008456105B2

(12) United States Patent
Wang et al.

(10) Patent No.: US 8,456,105 B2
(45) Date of Patent: Jun. 4, 2013

(54) DRIVING CIRCUIT CAPABLE OF ENHANCING ENERGY CONVERSION EFFICIENCY AND DRIVING METHOD THEREOF

(75) Inventors: Jing-Chyi Wang, Hsin-Chu (TW); Chi-Ming Chen, Hsin-Chu (TW)

(73) Assignee: Analog Integrations Corporation, Science Park, Hsin-Chu (TW)

( * ) Notice: Subject to any disclaimer, the term of this patent is extended or adjusted under 35 U.S.C. 154(b) by 274 days.

(21) Appl. No.: 13/114,064

(22) Filed: May 24, 2011

(65) Prior Publication Data

US 2012/0194096 A1 Aug. 2, 2012

(30) Foreign Application Priority Data

Jan. 28, 2011 (TW) ..... 100103328 A

(51) Int. Cl.
*H05B 37/02* (2006.01)

(52) U.S. Cl.
USPC ..... 315/294; 315/307; 315/193; 315/153

(58) Field of Classification Search
USPC ..... 315/291, 294, 295, 307–309, 312, 315/153, 185 R, 193
See application file for complete search history.

(56) References Cited

U.S. PATENT DOCUMENTS

| | | | | |
|---|---|---|---|---|
| 7,378,630 | B2 * | 5/2008 | Yoshida | 250/205 |
| 2007/0145914 | A1 * | 6/2007 | Hong et al. | 315/291 |
| 2010/0308739 | A1 * | 12/2010 | Shteynberg et al. | 315/193 |
| 2011/0068701 | A1 * | 3/2011 | van de Ven et al. | 315/185 R |
| 2011/0121741 | A1 * | 5/2011 | Yamamoto et al. | 315/193 |
| 2011/0227485 | A1 * | 9/2011 | Huynh | 315/127 |
| 2012/0217891 | A1 * | 8/2012 | Shin et al. | 315/250 |
| 2013/0002141 | A1 * | 1/2013 | Lee | 315/152 |
| 2013/0069547 | A1 * | 3/2013 | van de Ven et al. | 315/188 |
| 2013/0076247 | A1 * | 3/2013 | Chung et al. | 315/122 |

* cited by examiner

*Primary Examiner* — Don Le
(74) *Attorney, Agent, or Firm* — Winston Hsu; Scott Margo

(57) ABSTRACT

A driving circuit includes a switch, a detecting unit, and a current supply unit. A first terminal of the switch is used for coupling to a first terminal of a first LED group of a plurality of LED groups and receiving a first voltage, and a third terminal of the switch is used for coupling to a first terminal of a last LED group of the plurality of LED groups. The detecting unit is used for outputting a switch control signal to a second terminal of the switch for controlling turning-on and turning-off of the switch. The current supply unit has a plurality of input current terminals, and a ground terminal coupled to ground, where each input current terminal of the plurality of input current terminals is used for coupling to a second terminal of a corresponding LED group of the plurality of LED groups.

16 Claims, 9 Drawing Sheets

DRIVING CIRCUIT CAPABLE OF ENHANCING ENERGY CONVERSION EFFICIENCY AND DRIVING METHOD THEREOF

BACKGROUND OF THE INVENTION

1. Field of the Invention

The present invention is related to a driving circuit and driving method thereof, and particularly to a driving circuit and driving method thereof that can enhance energy conversion efficiency through staged load driving.

2. Description of the Prior Art

Please refer to FIG. 1A. FIG. 1A is a diagram illustrating a driving circuit 100 for driving light emitting diodes according to the prior art. As shown in FIG. 1A, the driving circuit 100 includes a rectifier 102 and a current supply unit 104. The rectifier 102 is used for receiving an alternating current voltage AC, and generating a first voltage V1 according to the alternating current voltage AC. The first voltage V1 is a direct current voltage and varies with time periodically. The first voltage V1 is used for driving a series of light emitting diodes 106, and the series of light emitting diodes 106 includes at least one light emitting diode. In FIG. 1A, input power of the driving circuit 100 is a sum of power consumption of the series of light emitting diodes 106 and power consumption of the current supply unit 104. Please refer to FIG. 1B. FIG. 1B is a diagram illustrating a relationship between the power consumption of the series of light emitting diodes 106 in FIG. 1A and the first voltage V1. As shown in FIG. 1B, the more light emitting diodes of the series of light emitting diodes 106 (that is, the larger a voltage drop V106 of the series of light emitting diodes 106), the larger the power consumption P106 of the series of light emitting diodes 106 (a driving current for driving the series of light emitting diodes 106 times the voltage drop V106), resulting in the smaller the power consumption of the current supply unit 104. However, a turned-on interval T of the series of light emitting diodes 106 is shorter, so luminance of the series of light emitting diodes 106 is insufficient.

Please refer to FIG. 2A and FIG. 2B. FIG. 2A is a diagram illustrating a driving circuit 200 for driving light emitting diodes through staged driving according to the prior art, and FIG. 2B is a diagram illustrating a relationship between power consumption of light emitting diodes in FIG. 2A and the first voltage V1. As shown in FIG. 2A, the driving circuit 200 includes a rectifier 202 and a current supply unit 204. As shown in FIG. 2B, as the first voltage V1 is gradually increased, light emitting diodes 2062, 2064, and 2066 of a series of light emitting diodes 206 are turned on in turn. That is to say, when the first voltage V1 is equal to a voltage V2062, the light emitting diode 2062 is turned on (the light emitting diodes 2064 and 2066 are turned off), and a driving current for driving the light emitting diode 2062 flows to the current supply unit 204 through a node S1. Similarly, when the first voltage V1 is equal to a voltage V2064, the light emitting diodes 2062, 2064 are turned on (the light emitting diode 2066 is turned off) and a driving current for driving the light emitting diodes 2062, 2064 flows to the current supply unit 204 through anode S2. When the first voltage V1 is equal to a voltage V2066, the light emitting diodes 2062, 2064, and 2066 are turned on and a driving current for driving the light emitting diodes 2062, 2064, and 2066 flows to the current supply unit 204 through a node S3. Therefore, as shown in FIG. 2B, the driving circuit 200 can increase power consumption of the series of light emitting diodes 206. That is to say, the power consumption of the series of light emitting diodes 206 is equal to a sum of power consumption P2062 of the light emitting diode 2062, power consumption P2064 of the light emitting diode 2064, and power consumption P2066 of the light emitting diode 2066. Thus, the driving circuit 200 can drive more light emitting diodes connected in series, enhance energy conversion efficiency, and not reduce luminance of the series of light emitting diodes 206. However, a disadvantage of the driving circuit 200 is that luminance of the light emitting diode 2066 is always lower than luminance of the light emitting diodes 2062 and 2064.

SUMMARY OF THE INVENTION

An embodiment provides a driving circuit capable of enhancing energy conversion efficiency. The driving circuit includes a switch, a detecting unit, and a current supply unit. The switch has a first terminal for coupling to a first terminal of a first light emitting diode group of a plurality of light emitting diode groups, and receiving a first voltage, a second terminal, and a third terminal for coupling to a first terminal of a last light emitting diode group of the plurality of light emitting diode groups. The detecting unit has an output terminal coupled to the second terminal of the switch for outputting a switch control signal, where the switch control signal is used for controlling turning-on and turning-off of the switch. The current supply unit has a plurality of input current terminals, and a ground terminal coupled to ground, where each input current terminal of the plurality of input current terminals is used for coupling to a second terminal of a corresponding light emitting diode group of the plurality of light emitting diode groups.

Another embodiment provides a driving method capable of enhancing energy conversion efficiency. The driving method includes driving a first light emitting diode group of a plurality of light emitting diode groups according to a first voltage; a switch receiving the first voltage and generating a second voltage; driving a last light emitting diode group of the plurality of light emitting diode groups according to the second voltage; a detecting unit comparing a voltage of a detecting terminal with a reference voltage to generate a detection result; the detecting unit controlling the switch to execute a corresponding operation according to the detection result.

Another embodiment provides a driving method capable of enhancing energy conversion efficiency. The driving method includes driving a first light emitting diode group of a plurality of light emitting diode groups according to a first voltage; a switch receiving the first voltage and generating a second voltage; driving a last light emitting diode group of the plurality of light emitting diode groups according to the second voltage; a detecting unit comparing a voltage drop between a first detecting terminal and a second detecting terminal with a reference voltage to generate a detection result; the detecting unit controlling the switch to execute a corresponding operation according to the detection result.

The present invention provides a driving circuit capable of enhancing energy conversion efficiency and a driving method thereof. The driving circuit and the driving method thereof utilize a detecting unit and a switch to first turn on a first light emitting diode group and a last light emitting diode group of a plurality of light emitting diode groups. Then, the last light emitting diode group is turned off and another light emitting diode group of the plurality of light emitting diode groups is turned on in turn. Further, a turning-off process of the plurality of light emitting diode groups is opposite to a turning-on process of the plurality of light emitting diode groups. Therefore, compared to the prior art, the present invention can enhance the energy conversion efficiency and have more uniform luminance.

These and other objectives of the present invention will no doubt become obvious to those of ordinary skill in the art after reading the following detailed description of the preferred embodiment that is illustrated in the various figures and drawings.

DETAILED DESCRIPTION

Figure 1A:
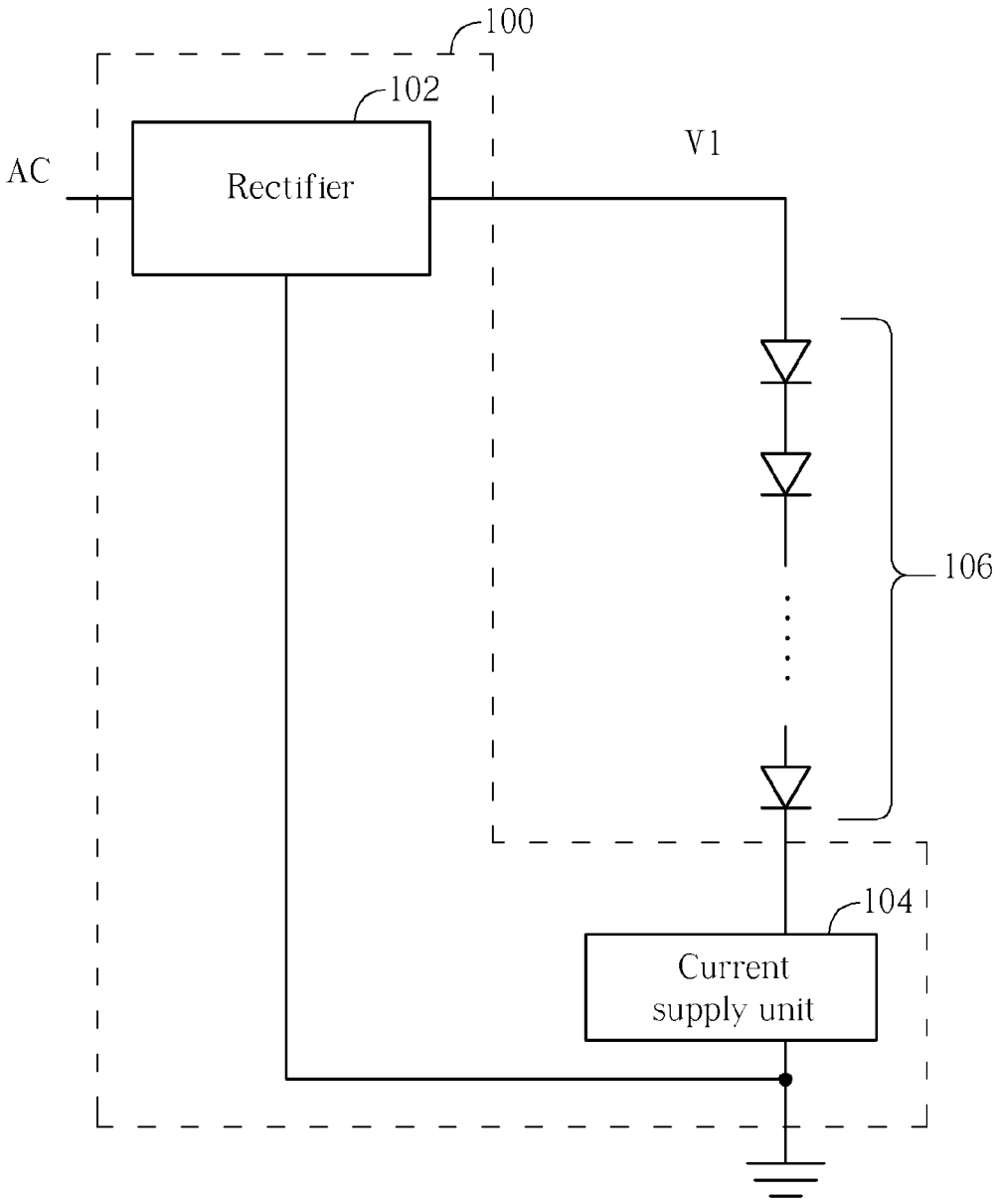
FIG. 1A PRIOR ART
FIG. 1A is a diagram illustrating a driving circuit for driving light emitting diodes according to the prior art.
Figure 1B:
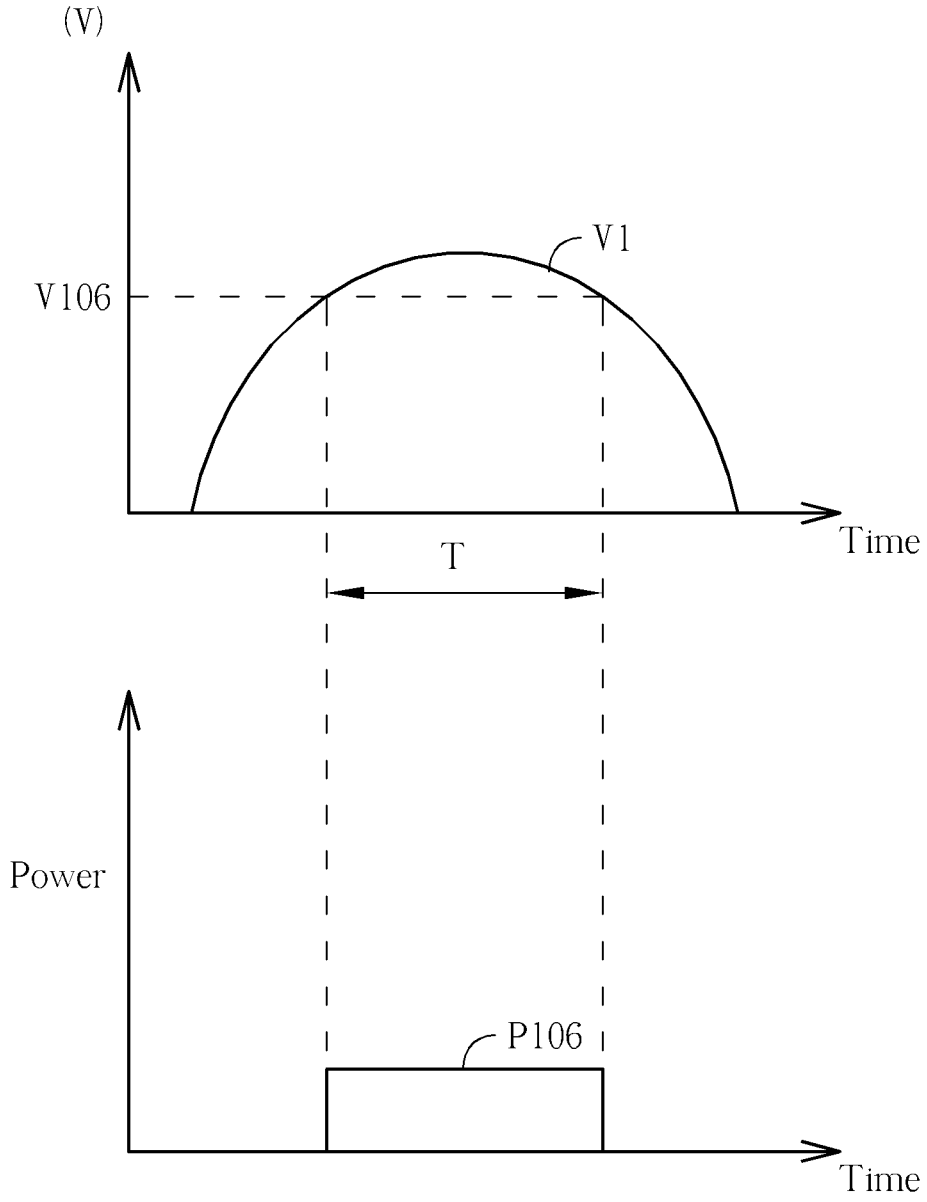
FIG. 1B PRIOR ART
FIG. 1B is a diagram illustrating a relationship between the power consumption of the series of light emitting diodes in FIG. 1A and the first voltage.
Figure 2A:
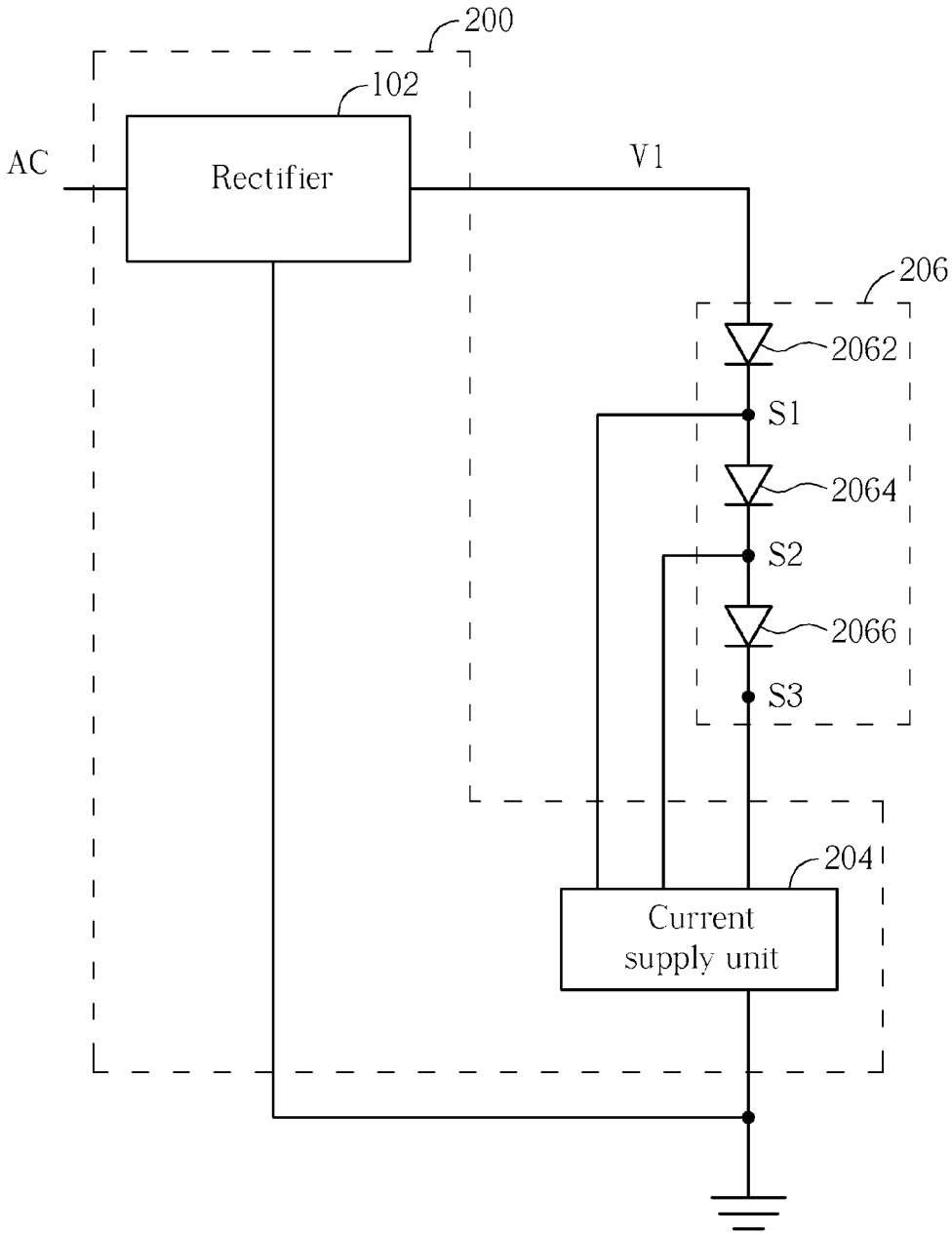
FIG. 2A PRIOR ART
FIG. 2A is a diagram illustrating a driving circuit for driving light emitting diodes through staged driving according to the prior art.
Figure 2B:
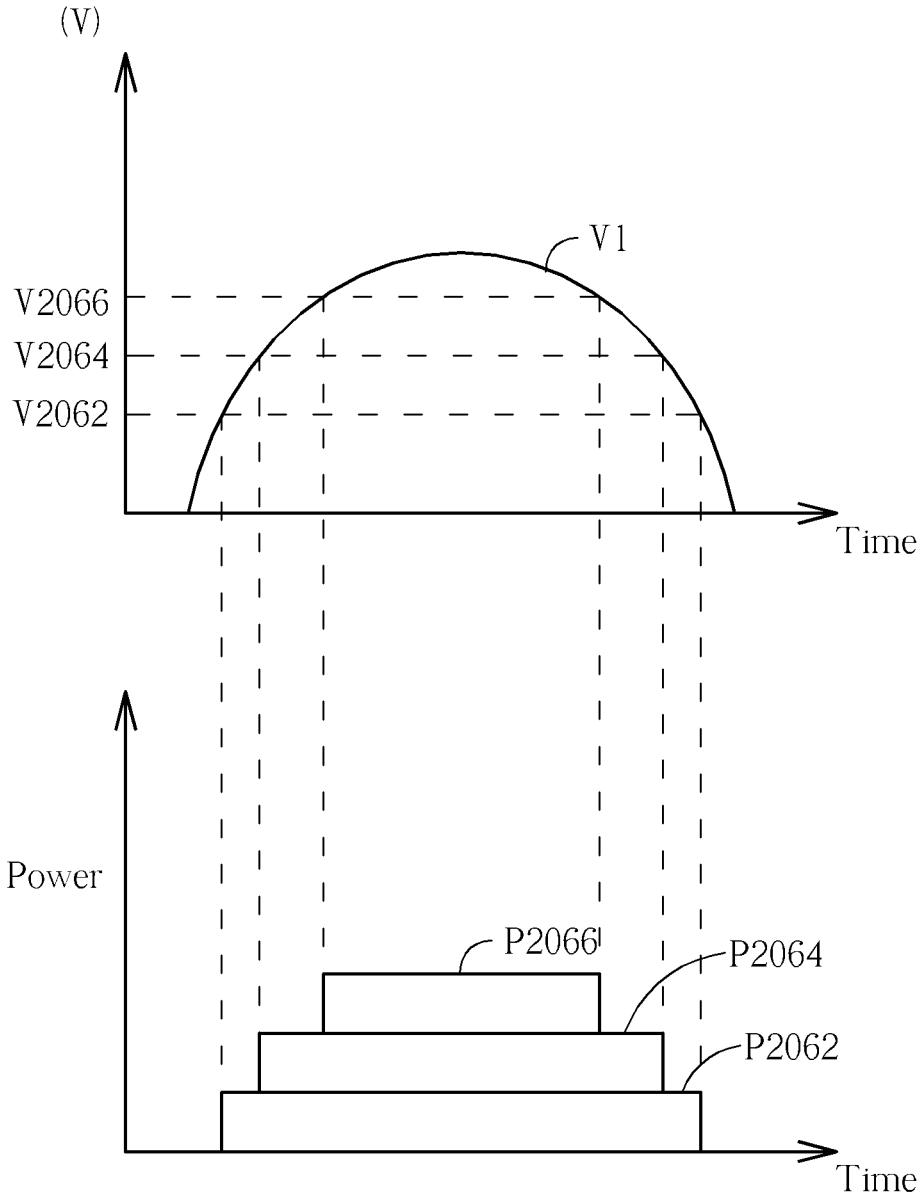
FIG. 2B PRIOR ART
FIG. 2B is a diagram illustrating a relationship between power consumption of light emitting diodes in FIG. 2A and the first voltage.
Figure 3A:
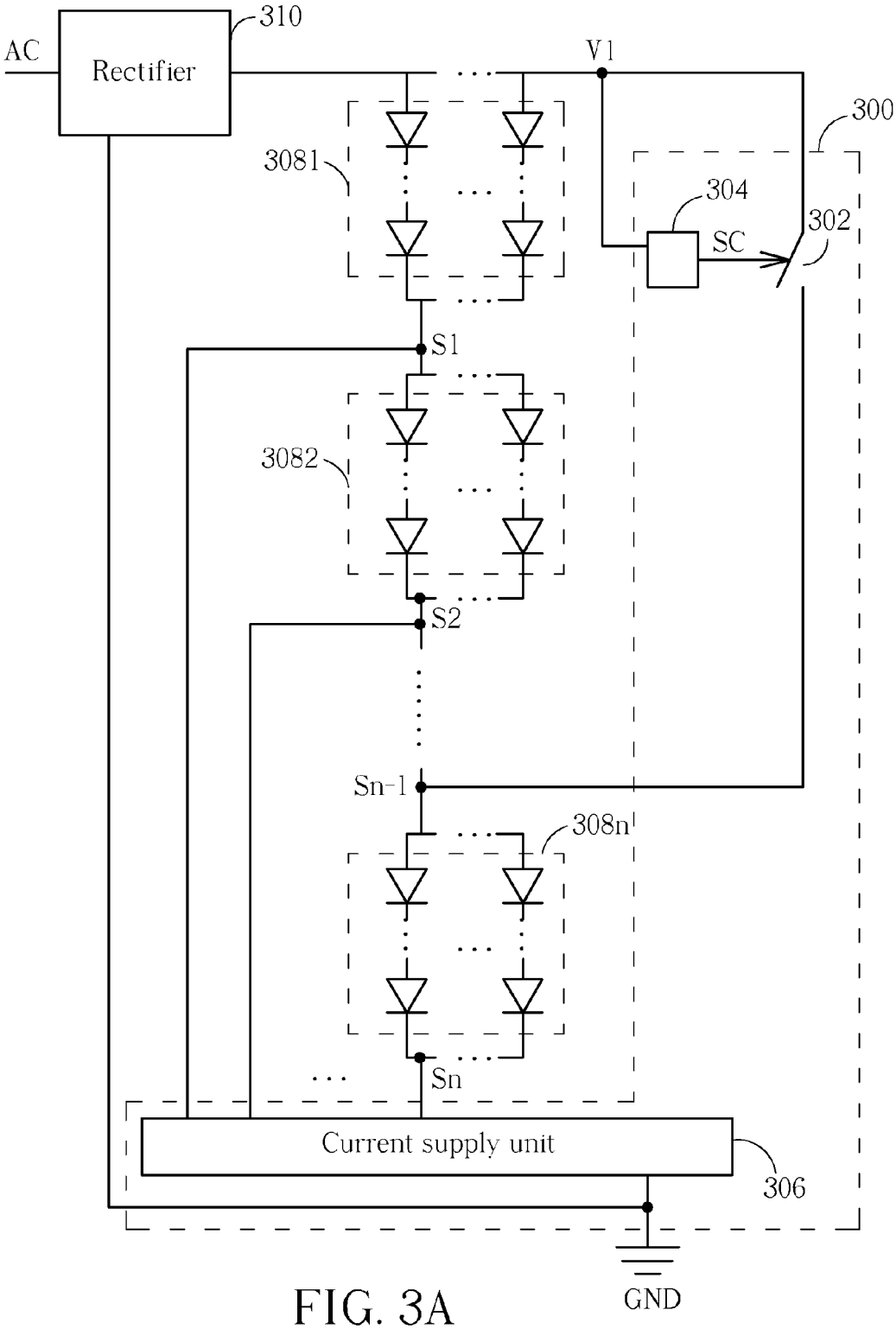
FIG. 3A and FIG. 3B are diagram illustrating a driving circuit capable of energy conversion efficiency according to an embodiment.
Figure 3B:
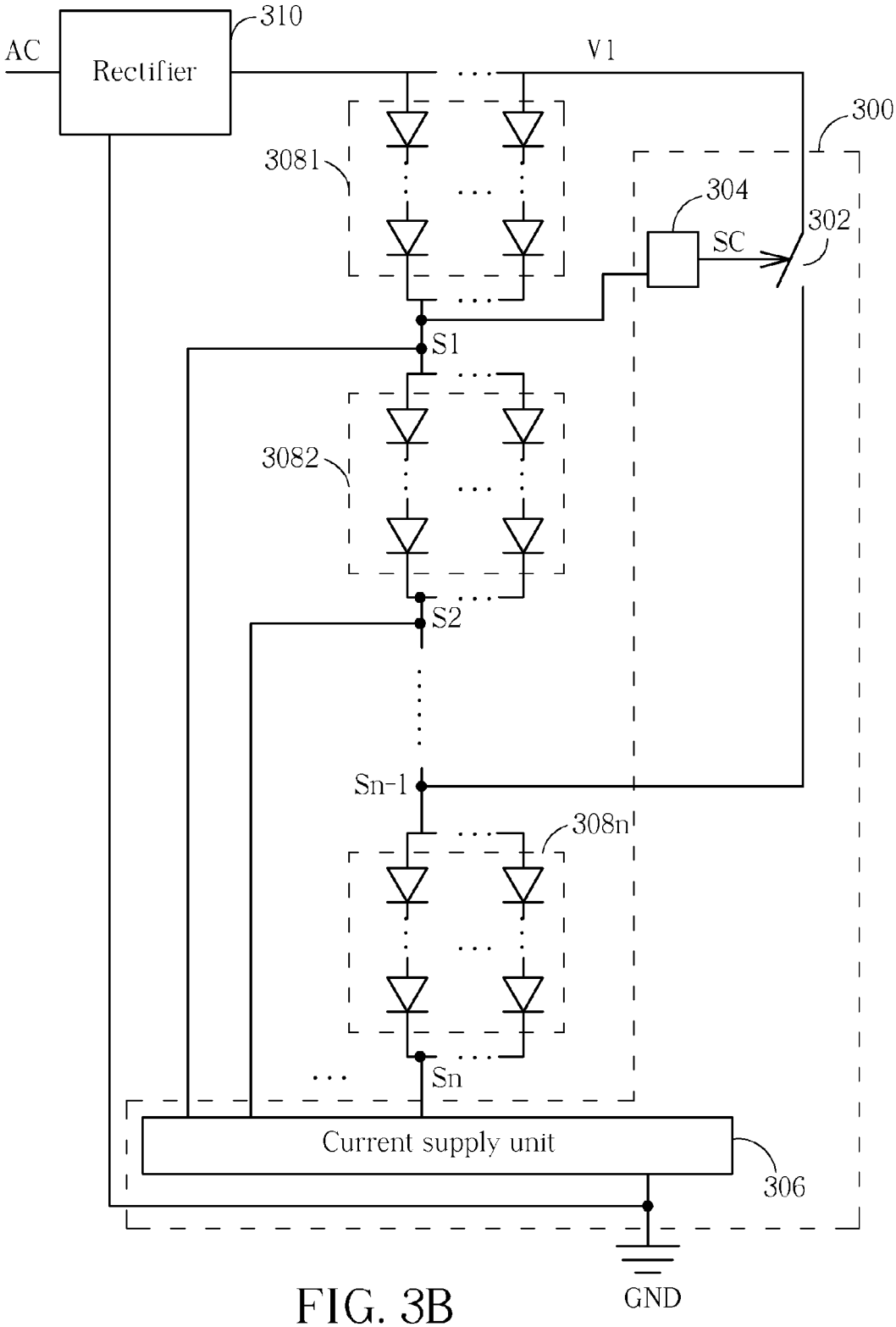

Please refer to FIG. 3A and FIG. 3B. FIG. 3A and FIG. 3B are diagrams illustrating a driving circuit 300 capable of energy conversion efficiency according to an embodiment. The driving circuit 300 includes a switch 302, a detecting unit 304, and a current supply unit 306. The switch 302 has a first terminal for coupling to a first terminal of a first light emitting diode group 3081 of a plurality of light emitting diode groups 3081-308*n*, and receiving a first voltage V1 generated by a rectifier 310, a second terminal, and a third terminal for coupling to a first terminal of a last light emitting diode group 308*n* of the plurality of light emitting diode groups 3081-308*n*. Each light emitting diode group of the plurality of light emitting diode groups 3081-308*n* includes at least one series of light emitting diodes, and light emitting diodes of each series of light emitting diodes of each light emitting diode group are the same. But, light emitting diodes of different light emitting diode groups of the plurality of light emitting diode groups 3081-308*n* may be the same or not. In addition, n is a positive integer, and $n \geqq 3$. The switch 302 is a P-type metal-oxide-semiconductor transistor, an N-type metal-oxide-semiconductor transistor, or a transmission gate. Further, the rectifier 310 is used for receiving an alternating current voltage AC, and generating the first voltage V1 according to the alternating current voltage AC. The first voltage V1 is a direct current voltage and varies with time periodically. The detecting unit 304 has a detecting terminal for coupling a terminal of the first light emitting diode group 3081 (as shown in FIG. 3A, the detecting terminal of the detecting unit 304 is used for coupling the first terminal of the first light emitting diode group 3081, and as shown in FIG. 3B, the detecting terminal of the detecting unit 304 is used for coupling a second terminal of the first light emitting diode group 3081) for detecting a voltage of the terminal of the first light emitting diode group 3081, and generating a switch control signal SC according to the voltage of the terminal of the first light emitting diode group 3081, and an output terminal coupled to the second terminal of the switch 302 for outputting the switch control signal SC, where the switch control signal SC is used for controlling turning-on and turning-off of the switch 302. The current supply unit 306 has a plurality of input current terminals, and a ground terminal coupled to ground GND, where each input current terminal of the plurality of input current terminals is used for coupling to a second terminal of a corresponding light emitting diode group of the plurality of light emitting diode groups 3081-308*n*. In addition, in another embodiment of FIG. 3A and FIG. 3B, the driving circuit 300 includes the rectifier 310.

Figure 4:
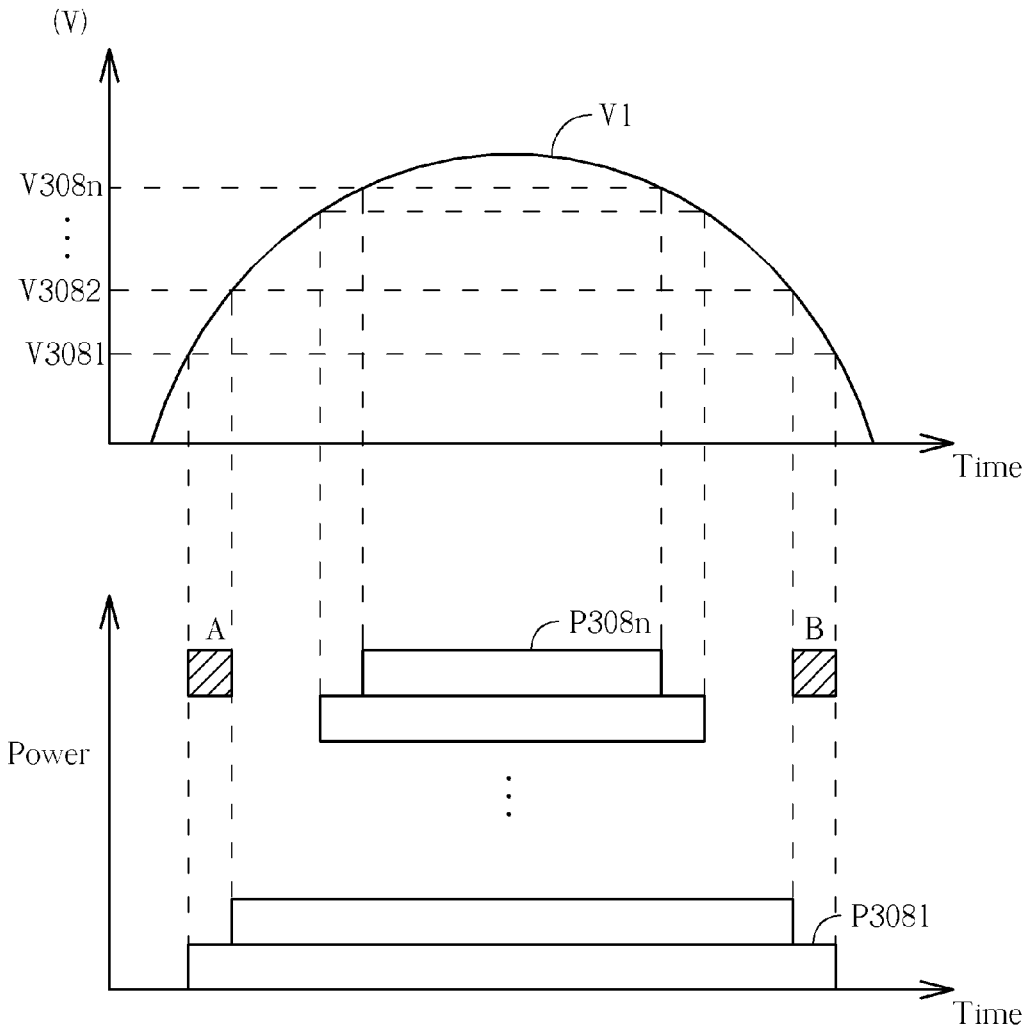
FIG. 4 is a diagram illustrating a relationship between the first voltage and power consumption of the plurality of light emitting diode groups in FIG. 3.

Please refer to FIG. 4. FIG. 4 is a diagram illustrating a relationship between the first voltage V1 and power consumption of the plurality of light emitting diode groups 3081-308*n* in FIG. 3A and FIG. 3B. As shown in FIG. 4, when the first voltage V1 is gradually increased to be greater than a voltage V3081, the first light emitting diode group 3081 and the last light emitting diode group 308*n* of the plurality of light emitting diode groups 3081-308*n* are turned on (a voltage drop of the first light emitting diode group 3081 is equal to a voltage drop of the last light emitting diode group 308*n*). That is to say, a driving current for driving the first light emitting diode group 3081 flows to the current supply unit 306 through a node S1, and a driving current for driving the last light emitting diode group 308*n* flows to the current supply unit 306 through nodes Sn−1, Sn and the switch 302. When the first voltage V1 is increased to be greater than a voltage V3082, the detecting unit 304 generates the switch control signal SC according to the voltage of the terminal of the first light emitting diode group 3081 to turn off the switch 302. Meanwhile, a driving current for driving the first light emitting diode group 3081 and a second light emitting diode group 3082 flows to the current supply unit 306 through node S2, and the last light emitting diode group 308*n* is turned off. Then, a third light emitting diode group 3083 and a fourth light emitting diode group 3084 are turned on in turn with increase of the first voltage V1 until the last light emitting diode group 308*n* is turned on again (meanwhile, the first voltage V1 is greater than a voltage V308*n*). In addition, as shown in FIG. 4, when the first voltage V1 is decreased gradually, a turning-off process of the plurality of light emitting diode groups 3081-308*n* is opposite to the above mentioned turning-on process of the plurality of light emitting diode groups 3081-308*n*. Therefore, the above mentioned turning-on and turning-off processes of the plurality of light emitting diode groups 3081-308*n* repeat with the first voltage V1 periodically. As shown in FIG. 4, power consumption of the plurality of light emitting diode groups 3081-308*n* is a sum of a plurality of power consumptions P3081-P308*n* and power consumption blocks A, B, where the power consumption blocks A, B represent power consumption of the last light emitting diode group 308*n* when the first voltage V1 is between the voltage V3081 and the voltage V3082.

Figure 5:
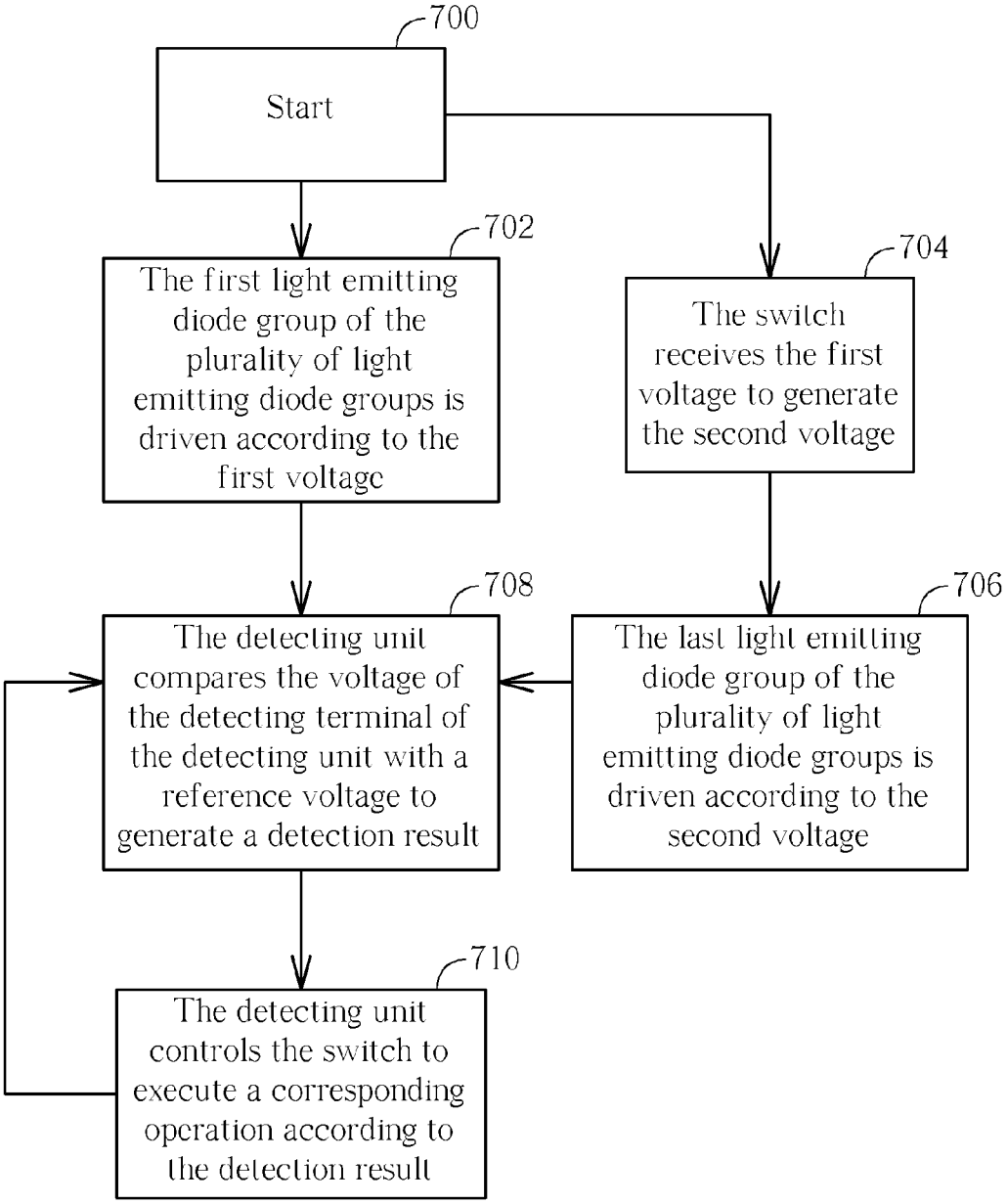
FIG. 5 is a flowchart illustrating a driving method capable of enhancing energy conversion efficiency according to another embodiment.

Please refer to FIG. 5. FIG. 5 is a flowchart illustrating a driving method capable of enhancing energy conversion efficiency according to another embodiment. The driving method in FIG. 5 uses the driving circuit 300 in FIG. 3A to illustrate the method. Detailed steps are as follows:

Step 700: Start.

Step 702: The first light emitting diode group 3081 of the plurality of light emitting diode groups 3081-308*n* is driven according to the first voltage V1.

Step 704: The switch 302 receives the first voltage V1 to generate the second voltage V2.

Step 706: The last light emitting diode group 308*n* of the plurality of light emitting diode groups 3081-308*n* is driven according to the second voltage V2.

Step 708: The detecting unit 304 compares the voltage of the detecting terminal of the detecting unit 304 with a reference voltage to generate a detection result DR.

Step 710: The detecting unit 304 controls the switch 302 to execute a corresponding operation according to the detection result DR; go to the Step 708.

In Step 702, the rectifier 310 generates the first voltage V1 according to the alternating current voltage AC. When the first voltage V1 is gradually increased to be greater than the voltage V3081, the first light emitting diode group 3081 is turned on. In Step 704, the switch 302 receives the first voltage V1 to generate the second voltage V2, where the switch 302 is turned on until the first voltage V1 is equal to the voltage V3082. Therefore, in Step 706, the last light emitting diode group 308*n* of the plurality of light emitting diode groups 3081-308*n* is turned on according to the second voltage V2. In Step 708, the detecting unit 304 continuously compares the voltage of the detecting terminal of the detecting unit 304 with a reference voltage to generate the detection result DR, where the voltage of the detecting terminal of the detecting unit 304 is the voltage of the first terminal of the first light emitting diode group 3081 or the voltage of the second terminal of the first light emitting diode group 3081. In Step 710, when the voltage of the first terminal of the first light emitting diode group 3081 (the first voltage V1) is gradually increased to be greater than the reference voltage (meanwhile, the reference voltage is the voltage V3082), the detecting unit 304 turns off the switch 302 according to the switch control signal SC. Therefore, the last light emitting diode group 308*n* is turned off until the first voltage V1 is great enough to drive all of the plurality of light emitting diode groups 3081-308*n*. Similarly, when the voltage of the second terminal of the first light emitting diode group 3081 (a voltage of the node 51) is greater than the reference voltage (meanwhile, the reference voltage is the first voltage V1 minus the voltage drop of the first light emitting diode group 3081), the detecting unit 304 turns off the switch 302 according to the switch control signal SC. Therefore, the last light emitting diode group 308*n* is turned off until the first voltage V1 is great enough to drive all of the plurality of light emitting diode groups 3081-308*n*. In addition, in step 710, when the voltage of the first terminal of the first light emitting diode group 3081 (the first voltage V1) is less than the reference voltage (meanwhile, the reference voltage is the voltage V3082), the detecting unit 304 turns on the switch 302 according to the switch control signal SC. Therefore, only the first light emitting diode group 3081 and the last light emitting diode group 308*n* are turned on. When the first voltage V1 is smaller than the voltage V3081, all of the plurality of light emitting diode groups 3081-308*n* are turned off. Similarly, when the voltage of the second terminal of the first light emitting diode group 3081 is smaller than the reference voltage (the first voltage V1 minus the voltage drop of the first light emitting diode group 3081), the detecting unit 304 turns on the switch 302 according to the switch control signal SC. Therefore, only the first light emitting diode group 3081 and the last light emitting diode group 308*n* are turned on.

Figure 6:
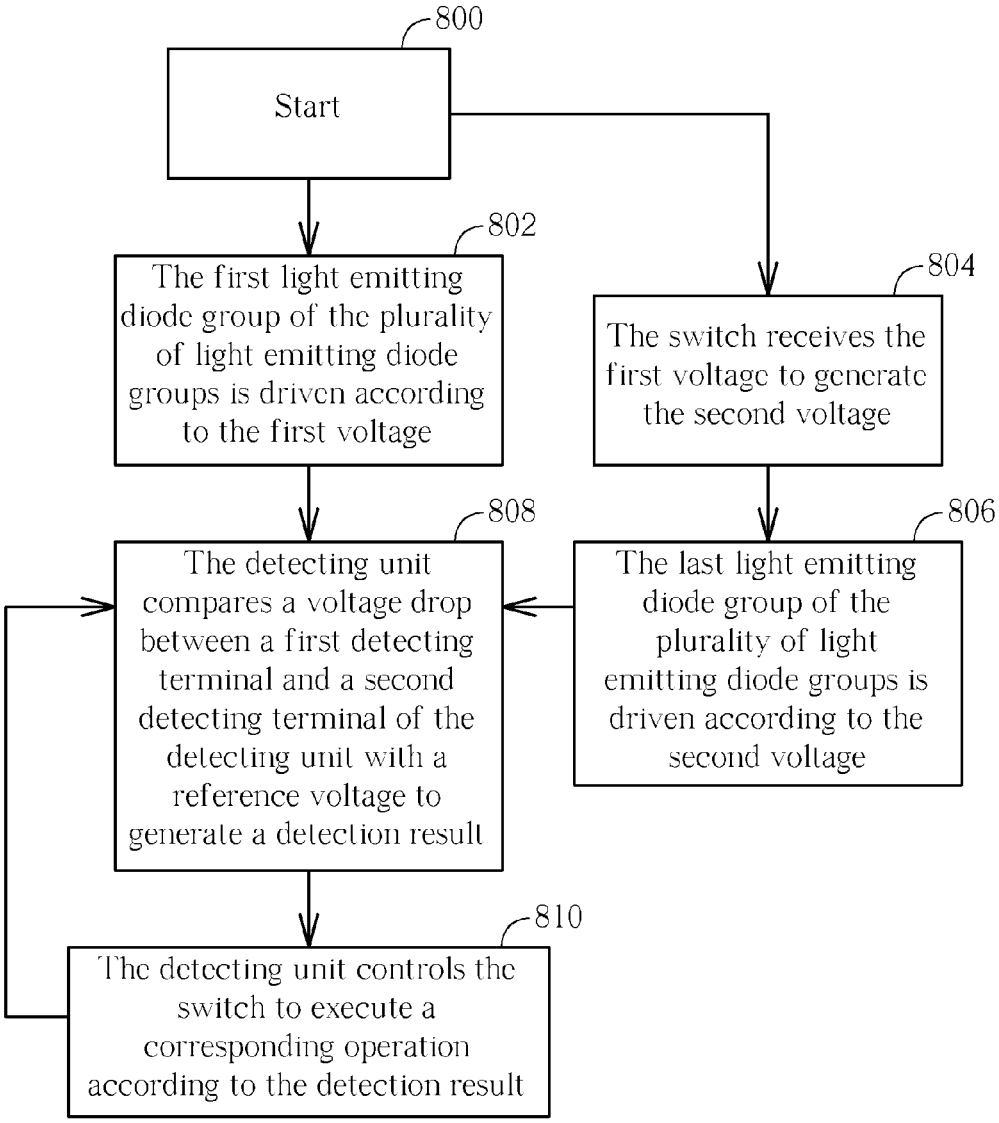
FIG. 6 is a flowchart illustrating a driving method capable of enhancing energy conversion efficiency according to another embodiment.

Please refer to FIG. 6. FIG. 6 is a flowchart illustrating a driving method capable of enhancing energy conversion efficiency according to another embodiment. The driving method in FIG. 6 uses the driving circuit 300 in FIG. 3A to illustrate the method. Detailed steps are as follows:

Step 800: Start.

Step 802: The first light emitting diode group 3081 of the plurality of light emitting diode groups 3081-308*n* is driven according to the first voltage V1.

Step 804: The switch 302 receives the first voltage V1 to generate the second voltage V2.

Step 806: The last light emitting diode group 308*n* of the plurality of light emitting diode groups 3081-308*n* is driven according to the second voltage V2.

Step 808: The detecting unit 304 compares a voltage drop between a first detecting terminal and a second detecting terminal of the detecting unit 304 with a reference voltage to generate a detection result DR.

Step 810: The detecting unit 304 controls the switch 302 to execute a corresponding operation according to the detection result DR; go to the Step 808.

A difference between the method in FIG. 6 and the method in FIG. 5 is that in Step 808, the detecting unit 304 compares the voltage drop between the first detecting terminal and the second detecting terminal of the detecting unit 304 with the reference voltage to generate the detection result DR, where the voltage drop between the first detecting terminal and the second detecting terminal of the detecting unit 304 is the voltage drop between the first terminal and the second terminal of the first light emitting diode group 3081. In Step 810, when the voltage drop between the first terminal and the second terminal of the first light emitting diode group 3081 is greater than the reference voltage (the voltage V3082 minus the voltage V3081), the detecting unit 304 turns off the switch 302 according to the switch control signal SC. Therefore, the last light emitting diode group 308*n* is turned off until the first voltage V1 is great enough to drive all of the plurality of light emitting diode groups 3081-308*n*. In addition, in Step 810, when the voltage drop between the first terminal and the second terminal of the first light emitting diode group 3081 is smaller than the reference voltage, the detecting unit 304 turns on the switch 302 according to the switch control signal SC. Meanwhile, only the first light emitting diode group 3081 and the last light emitting diode group 308*n* are turned on. However, when the first voltage V1 is smaller than the voltage V3081, all of the plurality of light emitting diode groups 3081-308*n* are turned off.

To sum up, the driving circuit capable of enhancing the energy conversion efficiency and the driving method thereof utilize the detecting unit and the switch to first turn on the first light emitting diode group and the last light emitting diode group of the plurality of light emitting diode groups. Then, the last light emitting diode group is turned off and another light emitting diode group of the plurality of light emitting diode groups is turned on in turn. Further, the turning-off process of the plurality of light emitting diode groups is opposite to the turning-on process of the plurality of light emitting diode groups. Therefore, compared to the prior art, the present invention can enhance the energy conversion efficiency and have more uniform luminance.

Those skilled in the art will readily observe that numerous modifications and alterations of the device and method may be made while retaining the teachings of the invention.

What is claimed is:

1. A driving circuit capable of enhancing energy conversion efficiency, the driving circuit comprising:

a switch having a first terminal for coupling to a first terminal of a first light emitting diode group of a plurality of light emitting diode groups, and receiving a first voltage, a second terminal, and a third terminal for coupling to a first terminal of a last light emitting diode group of the plurality of light emitting diode groups;

a detecting unit having an output terminal coupled to the second terminal of the switch for outputting a switch control signal, wherein the switch control signal is used for controlling turning-on and turning-off of the switch; and a current supply unit having a plurality of input current terminals, and a ground terminal coupled to ground, wherein each input current terminal of the plurality of input current terminals is used for coupling to a second terminal of a corresponding light emitting diode group of the plurality of light emitting diode groups.

2. The driving circuit of claim 1, wherein the detecting unit further comprises a detecting terminal for coupling to a terminal of the first light emitting diode group of the plurality of light emitting diode groups for detecting a voltage of the terminal of the first light emitting diode group, and generating the switch control signal according to the voltage of the terminal of the first light emitting diode group.

3. The driving circuit of claim 1, wherein the detecting unit further comprises a first detecting terminal for coupling to the first terminal of the first light emitting diode group of the plurality of light emitting diode groups, and a second detecting terminal coupled to a second terminal of the first light emitting diode group, wherein the detecting unit is used for generating the switch control signal according to a voltage drop between the first detecting terminal and the second detecting terminal of the detecting unit.

4. The driving circuit of claim 1, wherein the switch is a P-type metal-oxide-semiconductor transistor.

5. The driving circuit of claim 1, wherein the switch is an N-type metal-oxide-semiconductor transistor.

6. The driving circuit of claim 1, wherein the switch is a transmission gate.

7. The driving circuit of claim 1, wherein each light emitting diode group of the plurality of light emitting diode groups includes at least one series of light emitting diodes, and each series of light emitting diodes of the at least one series of light emitting diodes includes at least one light emitting diode.

8. The driving circuit of claim 1, further comprising:

a rectifier for receiving an alternating current voltage, and generating the first voltage according to the alternating current voltage.

9. A driving method capable of enhancing energy conversion efficiency, the driving method comprising:

driving a first light emitting diode group of a plurality of light emitting diode groups according to a first voltage;

a switch receiving the first voltage and generating a second voltage;

driving a last light emitting diode group of the plurality of light emitting diode groups according to the second voltage;

a detecting unit comparing a voltage of a detecting terminal with a reference voltage to generate a detection result; and the detecting unit controlling the switch to execute a corresponding operation according to the detection result.

10. The driving method of claim 9, wherein when the detection result shows the voltage of the detecting terminal is larger than the reference voltage, the detecting unit turns off the switch.

11. The driving method of claim 9, wherein when the detection result shows the voltage of the detecting terminal is smaller than the reference voltage, the detecting unit turns on the switch.

12. The driving method of claim 9, wherein the voltage of the detecting terminal is a voltage of a terminal of the first light emitting diode group of the plurality of light emitting diode groups.

13. A driving method capable of enhancing energy conversion efficiency, the driving method comprising:

driving a first light emitting diode group of a plurality of light emitting diode groups according to a first voltage;

a switch receiving the first voltage and generating a second voltage;

driving a last light emitting diode group of the plurality of light emitting diode groups according to the second voltage;

a detecting unit comparing a voltage drop between a first detecting terminal and a second detecting terminal with a reference voltage to generate a detection result; and the detecting unit controlling the switch to execute a corresponding operation according to the detection result.

14. The driving method of claim 13, wherein when the detection result shows the voltage drop between the first detecting terminal and the second detecting terminal is larger than the reference voltage, the detecting unit turns off the switch.

15. The driving method of claim 13, wherein when the detection result shows the voltage drop between the first detecting terminal and the second detecting terminal is smaller than the reference voltage, the detecting unit turns on the switch.

16. The driving method of claim 13, wherein the voltage drop between the first detecting terminal and the second detecting terminal is a voltage drop between a first terminal and a second terminal of the first light emitting diode group of the plurality of light emitting diode groups.

* * * * *